US007516624B2

(12) United States Patent
Weeth

(10) Patent No.: US 7,516,624 B2
(45) Date of Patent: Apr. 14, 2009

(54) COOLING ROOM

(76) Inventor: Frederic R. Weeth, 1346 Skyview Dr., Seaside, CA (US) 93955-5622

( * ) Notice: Subject to any disclaimer, the term of this patent is extended or adjusted under 35 U.S.C. 154(b) by 374 days.

(21) Appl. No.: 11/143,017

(22) Filed: Jun. 1, 2005

(65) Prior Publication Data

US 2006/0272350 A1 Dec. 7, 2006

(51) Int. Cl.
*F25D 17/08* (2006.01)

(52) U.S. Cl. ..... 62/419; 62/426; 62/239

(58) Field of Classification Search ..... 62/419, 62/239, 407–424; 454/118
See application file for complete search history.

(56) References Cited

U.S. PATENT DOCUMENTS

| | | | | |
|---|---|---|---|---|
| 2,279,847 | A | 4/1942 | Stebbins | |
| 3,246,592 | A | 4/1966 | Rath | |
| 4,123,917 | A | 11/1978 | Curtis | |
| 4,143,588 | A | 3/1979 | Exler | |
| 4,377,935 | A | 3/1983 | Curtis | |
| 4,454,723 | A | 6/1984 | Weasel, Jr. | |
| 4,532,774 | A | 8/1985 | Burns | |
| 4,565,071 | A | 1/1986 | Bartling | |
| 4,811,752 | A * | 3/1989 | Lyons et al. | 137/77 |
| 5,419,153 | A | 5/1995 | Hartley | |
| 5,566,608 | A * | 10/1996 | Vejdani et al. | 99/475 |
| 5,778,557 | A | 7/1998 | Leavens | |
| 5,789,007 | A | 8/1998 | Biano | |
| 6,012,384 | A * | 1/2000 | Badalament et al. | 99/475 |
| 6,431,060 | B1 * | 8/2002 | Gutheim | 99/475 |
| 6,457,402 | B1 * | 10/2002 | Parker et al. | 99/475 |
| 6,478,669 | B1 * | 11/2002 | Van | 454/118 |
| 6,792,772 | B1 * | 9/2004 | Seiss et al. | 62/415 |
| 6,923,111 | B2 * | 8/2005 | Kiefer et al. | 99/468 |
| 7,017,366 | B2 * | 3/2006 | Bottom | 62/407 |
| 2003/0029925 | A1 | 2/2003 | Riley | |

* cited by examiner

*Primary Examiner*—William E Tapolcai
(74) *Attorney, Agent, or Firm*—Brent A. Capehart; Bowers Law Firm

(57) ABSTRACT

The invention provides a container for cooling produce. The container includes a box-like housing and a common plenum wall, creating a supply air distribution plenum, a return air distribution plenum and a treatment zone therebetween. Within the treatment zone, produce can be placed. A plurality of openings are located within the common plenum wall allows air flow to pass between the plenums and the treatment zone, and thus cooling the produced located therein.

10 Claims, 12 Drawing Sheets

COOLING ROOM

REFERENCE TO PENDING APPLICATIONS

This application does not reference any pending application.

REFERENCE TO MICROFICHE APPENDIX

This application is not referenced in any microfiche appendix.

FIELD OF THE INVENTION

The present invention is generally directed toward a cold room; more specifically, the present invention is directed toward a cold room for cooling produce including fruits and vegetables through a forced air process.

BACKGROUND OF THE INVENTION

The present state of forced air cooling to rapidly remove field heat from recently harvested produce is well known. Typical techniques utilizing force air cooling are disclosed in the publication "Commercial Cooling of Fruits and Vegetables" by Thompson et al, available through the University of California, Agriculture and Natural Resources Communication Services, Oakland, Calf. 94608, U.S. Pat. No. 4,123,917 issued to Curtis et al., and U.S. Pat. No. 4,532,774 issued to Burns.

Generally, harvested produce is packed into containers or bins. The cooling procedure to remove field heat from the produce is performed by utilizing high capacity fans that pull refrigerated air through the produce. Forcing refrigerated air to come into contact with warm produce at high speeds results in the rapid convective cooling of the produce. The cooling of the produce in a uniform manner is objective. Uneven cooling of the produce can result in damaged produce or produce not cooled to a sufficient temperature.

A process for forced air cooling is known as tunnel cooling within a cooling room. The process includes creating an air tunnel by placing two parallel rows of palletized boxes with a space between the rows. The top and ends of the pallets are covered with a tarp. The space between the rows of pallets, above the floor, and under the covering tarp forms a tunnel, otherwise known as a return air plenum.

The typical prior art design for implementing this process includes a refrigeration unit provides high pressure, refrigerated air into the cooling room. The walls, floor, and ceiling of the cooling room form a supply air plenum directing the refrigerated air across the produce. A fan is used to create a pressure differential with low pressure in the return air plenum. The pressure differential causes refrigerated air to be pulled through the produce into the return plenum. The return air plenum removes the warmed air from the cooling room and passes the warmed air through to the refrigeration unit. The now-refrigerated air is recycled back into the cooling room, thus completing the air circulation cycle.

A disadvantage with the prior art designs is that air velocity and pressure differential is not uniform throughout the return and supply plenums. The air velocity within the two plenums is highest near the fan. Additionally, the pressure differential between the plenums is also highest near the fan. The lack of uniform air velocity and pressure differential causes the produce to cool unevenly with produce nearest the fan cooling more rapidly than produce farthest from the fan.

An additional disadvantage is that the lack of air velocity and pressure differential uniformity limits the number of pallets of produce that can be cooled in one room.

Another disadvantage is that if a cooling system is to be utilized for a number of fruits and vegetables, the system design must be able to adjust air velocities and adjust pressure differentials between the plenums. Different types of fruits and vegetables require various air velocities for optimum cooling rates. Carton or box design, amount and type of box ventilation, and type of packing liners all impact the pressure differential necessary to move air through the produce.

A further disadvantage is that many produce cooling needs are seasonal. Conventional fixed base forced air cooling rooms service such seasonal markets are idle during the off season.

A number of inventions disclose methods designed to improve uniform air velocity and pressure differential within a forced air cooling room or to provide transportable cooling rooms.

U.S. Pat. No. 5,566,608 Vejdani teaches that placement of the supply and return fans at the end of the cooling room creates a definite length limit to the room such that a single air handling unit can only accommodate a predetermined number of pallets of produce. Vejdani discloses an apparatus placing the air handler on top of the product.

U.S. Pat. No. 4,377,935 Curtis discloses an apparatus that utilizes a sub-floor return air plenum. However, this disclosure is cumbersome to create and does not provide uniform air flow across the pallets of produce.

U.S. Pat. No. 5,789,007 Bianco discloses an apparatus that utilizes multiple top mounted air handlers to provide axial air circulation but does not provide even longitudinal air circulation between the axial partitions.

While the prior art illustrates efforts to cool produce through forced air cooling processes, the prior art does not adequately address the need for uniform management of air velocity and pressure differential along the longitudinal axis of forced air produce cooling supply or return air plenums. Thus, there is a need to provide a forced air produce cooling room that addresses the disadvantages of the prior art.

BRIEF SUMMARY OF THE INVENTION

The present invention satisfies the need discussed above. The present invention is generally directed toward a cold room; more specifically, the present invention is directed toward a portable cooling room for cooling produce.

One aspect of the present invention provides a container for cooling produce including a box like housing having a ceiling, two side walls, two end walls and a floor. A common plenum wall is located proximate to one of the side walls creating a plenum therebetween. A second plenum is created between a second common plenum wall and the other side wall. The area between the two plenum walls is defined as a treatment zone. The treatment zone is dimensioned such that it can accommodate a row of pallets therein. Each common plenum wall has a plurality of openings to allow the passage of conditioning air to pass therethrough.

A ventilation system in placed in communication with the two plenums providing circulation, and temperature control, to the conditioning air. A typical ventilation system includes a refrigeration component and an air movement component, such as a fan assembly. The refrigeration component provides cooling air into one of the plenums. The fan assembly draws air out of the second plenum. Due to the openings in the common plenum walls, the conditioning air passes from the first plenum into the treatment zone and then into the second plenum, creating a flow of conditioning air across the treatment zone and any item contained therein. These items can include pallets of produce to be cooled, such as strawberries, melons and lettuce.

Due to the openings located within the plenum walls, a uniform air flow can be created across the treatment zone. This uniform air flow allows for uniform cooling of items inside the treatment zone.

An additional aspect of the present invention includes having a common plenum wall proximate to the ceiling and a common plenum wall proximate to the floor. The openings contained within the ceiling plenum wall are located proximate to the side wall. The openings contained within the floor plenum wall are located proximate the longitudinal centerline of the floor. The treatment zone is located between the two common plenum walls. This configuration is adapted for use with two rows of produce pallets. The air flow can travel from the ceiling plenum into the treatment zone, across the rows of pallets and out the floor plenum.

Another aspect of the ventilation system includes a fan assembly moveable between the two plenums. This would allow for the circulation between the air flow to be reversed without having to remove items located within the treatment zone.

To further control the air flow through the treatment zone, another aspect of the present invention includes a flow barrier secured to the ceiling of the housing. This flow barrier can be lowered, or extended, from the ceiling onto the top of the items in the treatment zone. This reduces the amount of space above the items and concentrates the air flow through the treatment zone. Additionally, this flow barrier could be used to allow both configuration, i.e. side plenums or ceiling/floor plenums to be operational.

Further features of the present invention will be apparent to those skilled in the art upon reference to the accompanying drawings and upon reading the following description of the preferred embodi [0001] An other aspect of the present invention includes a method to cool fruits and vegetables including providing a cooling room and cooling the fruits and vegetables therein. The cooling room is configured as set out above. Cooling air is provided into one of the plenums. A ventilation system creates circulation of the cooling air, which passes from one plenum, via openings contained in the plenum wall, through the treatment zone and into the other plenum via, openings contained in the other plenum wall. The openings allow for a substantially uniform pressure and velocity state of the air flow across the longitudinal length of the plenums.

DETAILED DESCRIPTION OF THE PREFERRED EMBODIMENTS

Before explaining the present invention in detail, it is to be understood that the invention is not limited to the preferred embodiments contained herein. The invention is capable of other embodiments and of being practiced or carried out in a variety of ways. It is to be understood that the phraseology and terminology employed herein are for the purpose of description and not of limitation.

Figure 1:
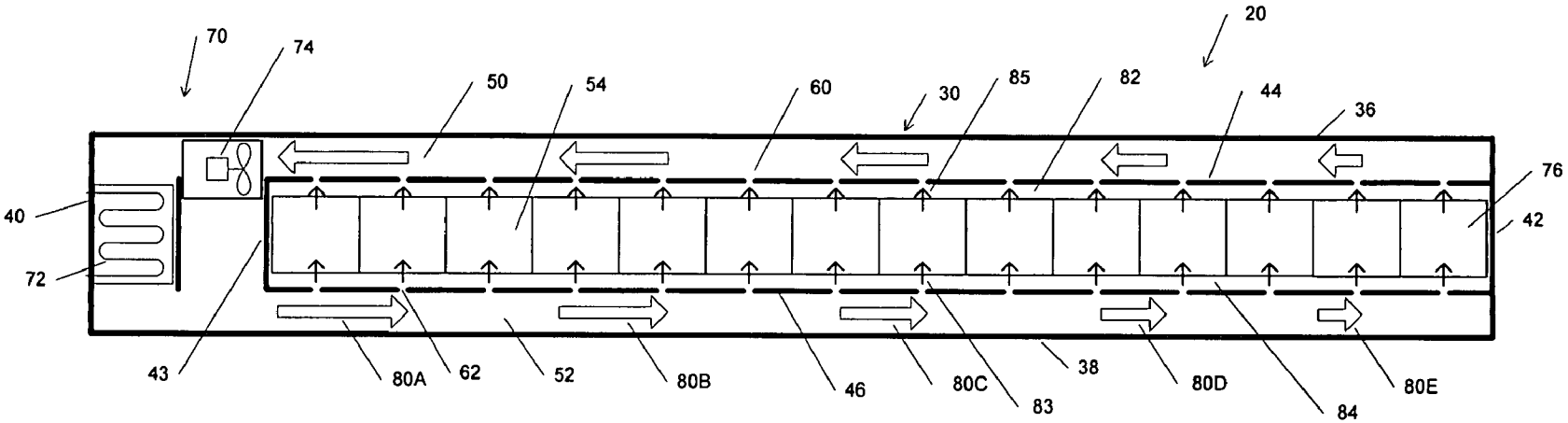
FIG. 1 is a top view of an embodiment 20 of the present invention illustrating air flow traveling in a counter clockwise direction.
Figure 2:
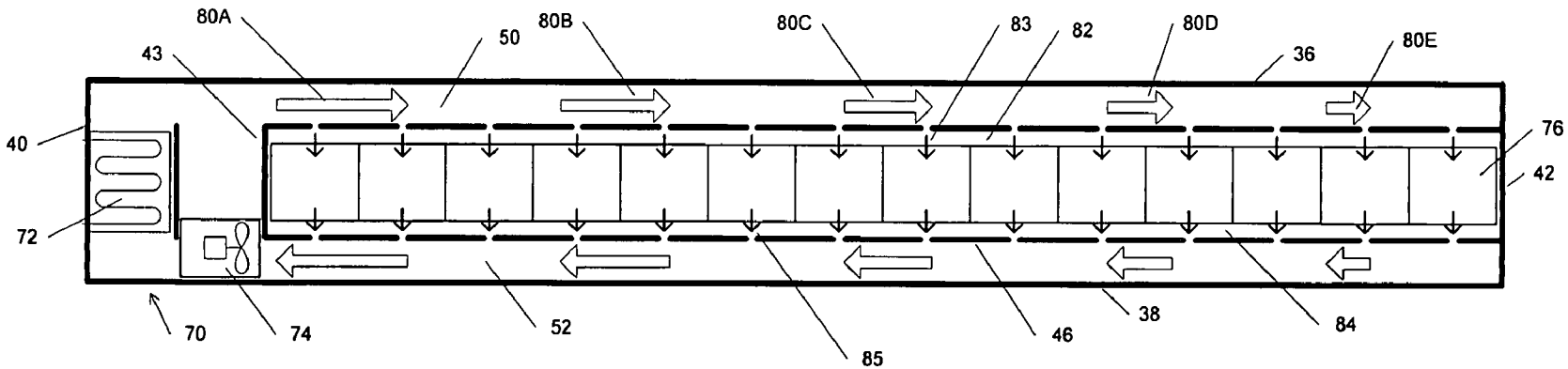
FIG. 2 is a top view of embodiment 20 of the present invention illustrating air flow traveling in a clockwise direction.

FIGS. 1-2 illustrate an embodiment 20 of the present invention, which comprises generally a housing 30 having a floor 32, a ceiling 34, two side walls 36, 38 and two end walls 40, 42.

Inside housing 30 is a common plenum end wall 43, a first common plenum wall 44and a second common plenum wall 46. Common plenum end wall 43 is located proximate first end wall 40, but does not contact either side walls 36 or 38. First common plenum wall 44 is located proximate to the first side wall 36 and extends from the second end wall 42 to common plenum end wall 43. A first plenum 50 is created between side wall 36 and common plenum wall 44. Second common plenum wall 46 is located proximate to the second side wall 38 and extends from the second end wall 42 to common plenum end wall 43. A second plenum 52 is created between side wall 38 and common plenum wall 46. A treatment zone 54 is created between the two plenum walls 44, 46. Produce can be placed within treatment zone 54 through an opening located in second end wall 42 not shown. Located within each common plenum walls 44, 46 are a plurality of openings 60, 62. These openings allow for air to pass between the plenums 50 and 52 and the treatment zone 54. The direction of the air flow is dependant upon the orientation of the ventilation system 70.

As an example of the operation of this embodiment 20, as illustrated in FIG. 1, cooling air 80 is provided into the second plenum 52 from a cooling unit 72. A fan assembly 74 is in communication with the first plenum 50. This fan assembly 74 creates a pressure differential between the air pressure in the first plenum 50 and the treatment zone 54. This pressure differential causes the cooling air to be drawn from the second plenum 52 into the treatment zone 54 via the openings 62 located within the second common plenum wall 46 and then into the first plenum 50 via the opening 60 located within the first common plenum wall 44. Due to the movement of the cooling air 80A-E passing through the treatment zone 54, the produce located therein is cooled to a desired temperature.

One of the disadvantages of the prior art is the air flow across produce is not uniform, causing uneven cooling of produce. The openings in the common plenum walls 44 and 46 provide for the cooling air 80 to pass through the treatment zone 54 in a uniform manner, causing an even cooling of the produce. The velocity of cooling air 80 is greatest at the inlet and outlet of the first and second plenums 50, 52, and lowest at the distal end of those plenums, as illustrated by the length of arrows associated with reference numerals 80A-E. However, due to the openings 60, 62 a uniform layer of cooling air 83 forms within the treatment zone 54 proximate to the first common plenum wall 44 and remains uniform as illustrated by reference numeral 85 as it moves across the treatment zone 54. This example is illustrative of this embodiment. Those skilled in the art will recognize that other configurations are within the scope of this invention. One such additional configuration is illustrated in FIG. 2 wherein the fan assembly 74 is in communication with the second plenum 52. This configuration provides the same cooling effect, but in the opposite direction.

An additional embodiment of fan assembly 74 comprises one or more ventilation fans in communication with a support apparatus capable of allowing one or more the ventilation fans to move between two or more plenums. This support apparatus can include a support shuttle to house one or more ventilation fans slidably mounted within support tracks. The shuttle can be moved along the support tracks between two plenum to create alternate circulation patterns within the same housing without removing or otherwise disturbing the items located within the treatment zone.

One of the disadvantages of the prior art is the air flow across produce is not uniform, causing uneven cooling of produce. The openings in the common plenum walls 44 and 46 provide for the cooling air 80 to pass through the treatment zone 54 in a uniform manner, causing an even cooling of the produce.

Figure 4:
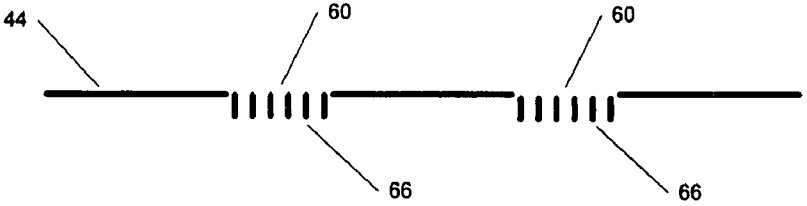
FIG. 4 is a top view of an embodiment of an air directing vane element of the present invention.
Figure 3:
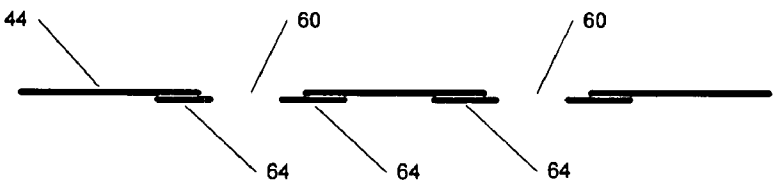
FIG. 3 is a top view of an embodiment of an adjustable aperture element of the present invention.
Figure 5:
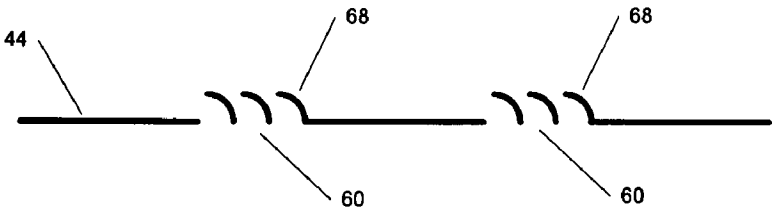
FIG. 5 is a top view of an embodiment of an air deflector element of the present invention.

Opening 60 and 62 can vary in opening size from one opening to another. This allows for differing amounts of air to pass between the respective plenum 50 or 52 and treatment zone 54. These varying opening size can be either non-adjustable or adjustable. Other embodiments of openings 60, 62 include additional structure to assist the flow of air to pass between one of the plenums 50, 52 and the treatment zone 54. Examples of this additional structure is illustrated in FIGS. 3-5. FIG. 3 illustrates a series of openings 60 having adjustable shields 64. These shields can be opened or closed depending on the amount of air flow needed to pass through that opening. FIG. 4 illustrates a series of openings 60 having air directing vanes 66 connected thereto. These vanes 66 assist in straightening the air flow passing through a common plenum wall. FIG. 5 illustrates a series of openings 60 having air deflectors 68 connected thereto. These air deflectors 68 assist in redirecting the air traveling along one of the plenums 44, 46 and into the treatment zone 54. These embodiments of additional structures are illustrative and not meant to be limiting. Those skilled in the art would recognize other suitable structures can be employed to aid in the movement of air flow between the plenums 44, 46 and treatment zone 54.

Treatment zone 54 can be of various dimensions. One dimension can be of a size to fit a standard sized pallet such that the pallet is in contact with both common plenum walls 44 and 46, not shown. FIGS. 1-2 illustrate another dimension that provided for space to be between a row of pallets 76 and common plenum walls 44 and 46. This space creates additional plenums 82 and 84 for the air flow. These plenums 82 and 84 augment the ability of the air flow to pass through the treatment zone 54 in a uniform manner.

Figure 6:
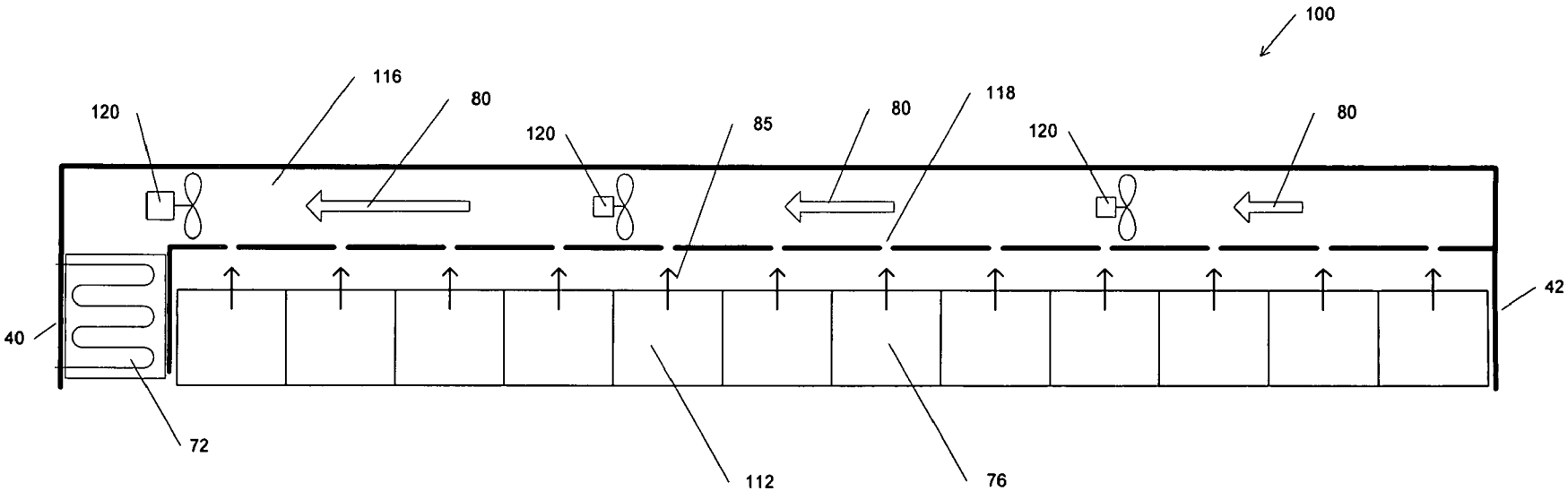
FIG. 6 is a top view of an embodiment 100 of the present invention illustrating multiple fans in a series in combination with a single return air distribution plenum.
Figure 9:
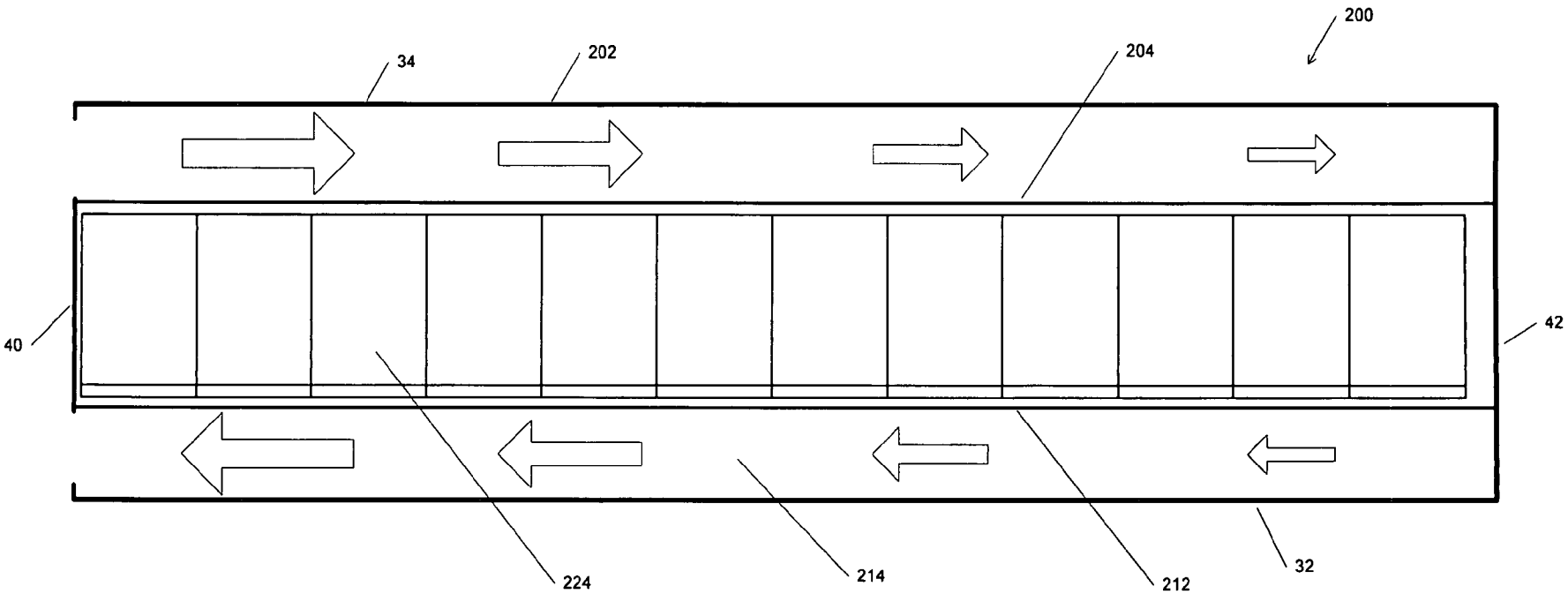
FIG. 9 is a side view of embodiment 200 of the present invention illustrating the direction of air flow.

FIG. 6 illustrates an additional embodiment 100 of the present invention. This embodiment 100 is configured as the embodiment illustrated in FIGS. 1-2, but has only a single common plenum wall 110 on the return side of treatment zone 112 creating a return plenum 114. A supply plenum 116 is created between the side wall 122 and the row of pallets 124. As in the previous embodiments, common plenum wall 110 has a plurality of openings 118, with each opening 116 having the same characteristics as set out above. Supplemental fans 120 are shown within return plenum 114. These fans 120 can be utilized to aid in drawing cooling air from the end of the supply plenum 116 distal from the cooling air inlet 124. FIG. 9 illustrates two supplement fans 120 being in use. This number is merely illustrative. Those skilled in the art can recognized that more or less, including no supplemental fans, can be utilized.

Figure 7:
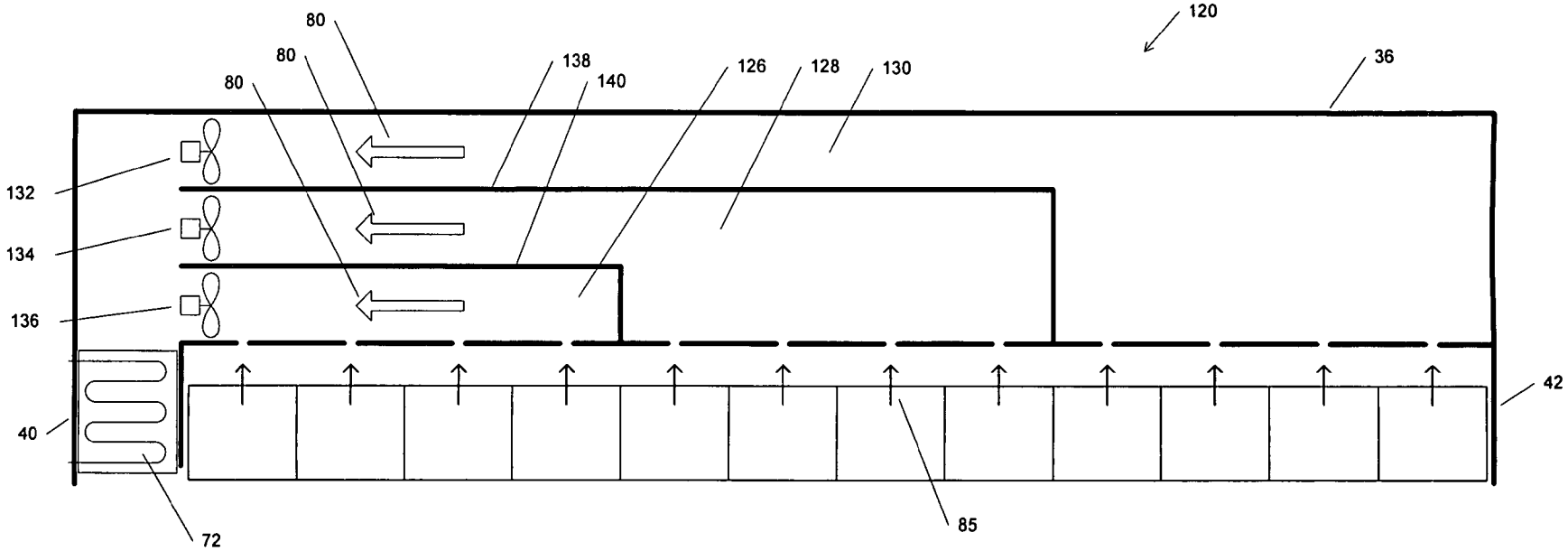
FIG. 7 is a top view of an embodiment 120 of the present invention illustrating a return plenum having multiple sub-plenums in a parallel.

FIG. 7 illustrates an additional embodiment 120 of the present invention. This embodiment 120 is configured as the embodiment illustrated in FIGS. 1-2, but has one or more dividers 138, 140 within one or both of the plenums 122, 124, creating distinct sub-plenums 126, 128 and 130. Each sub-plenum 126, 128 and 130 being distinct from the other sub-plenums and having distinct fan assemblies 132, 134 and 136 in communication therewith. The use of the dividers 138, 140 and fam assemblies 132, 134, and 136 allows for more control over the circulation of the air flow.

Figure 8:
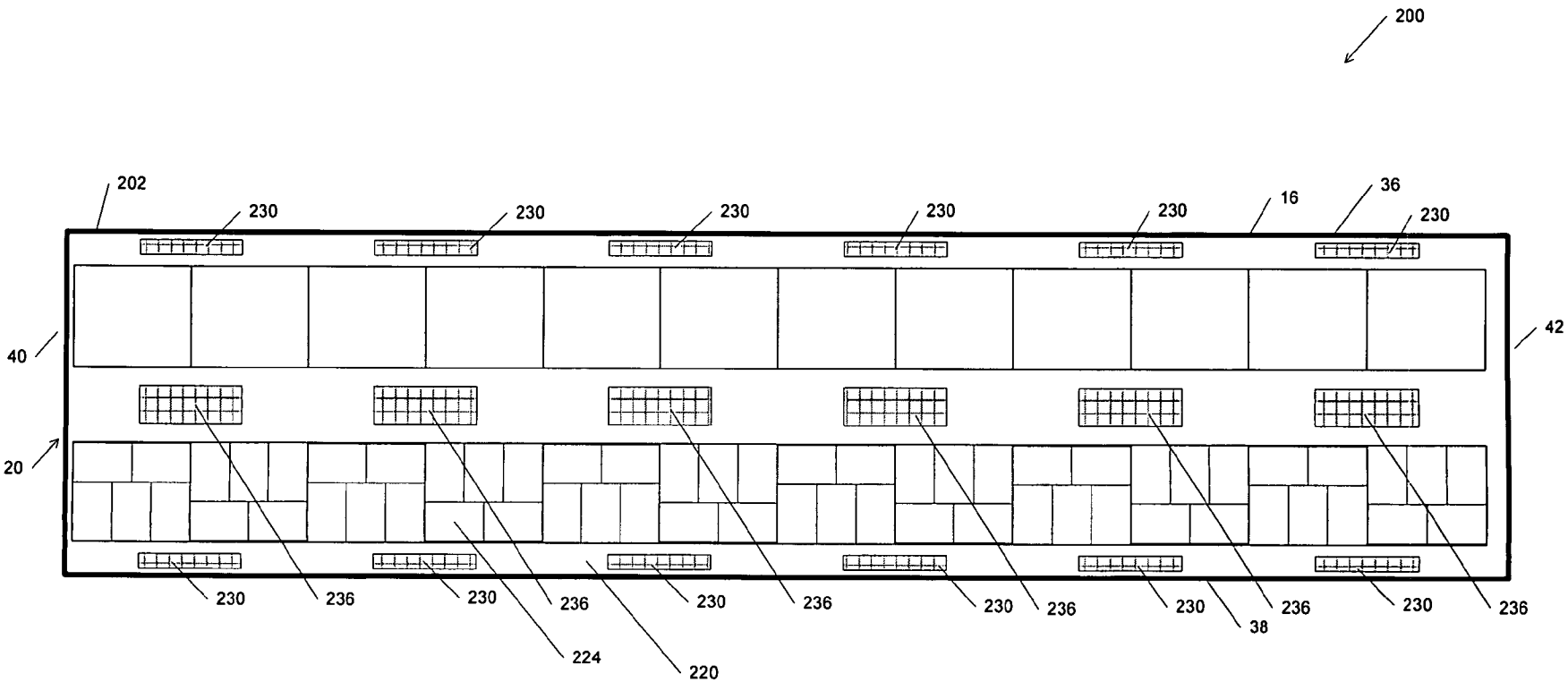
FIG. 8 is a top view of an embodiment 200 of the present invention.

An additional embodiment 200 is shown FIGS. 8-9 of the present invention is illustrated. The embodiment 200 comprises housing 202 as set out above, with the first common plenum wall 204 is located between the ceiling 206 and floor 208 proximate to the ceiling 206. This creates a ceiling plenum 210 between the first common plenum wall 204 and the ceiling 206. The second common plenum wall 212 is located between the ceiling 206 and floor 208 proximate to the floor 208. This creates a floor plenum 214 between the second common plenum wall 212 and the floor 208. The treatment zone 216 is created between the first common plenum wall 204 and the second common plenum wall 212.

The treatment zone 216 is dimensioned to accommodate a two rows of pallets 222, 224 while creating two side plenums 218, 220 between one of the row of pallets 222, 224 and the side walls 232, 234 A central plenum 226 is created between the two rows of pallets 222, 224.

Located within the first common plenum wall 204 are a plurality of openings 230 located proximate both side walls 232, 234. Openings 236 are located within the second common plenum wall 212 proximate to the longitudinal center line.

A ventilation system provides circulation to the air flow such that air is supplied to the ceiling plenum 210 and is removed from the housing 202 via the floor plenum 214. The air flow passes from the ceiling plenum into the treatment zone 216 via the openings 230 located in the first common plenum wall 204. This air travels along the two side walls respectively, via the two side plenums 218, 220, creating a uniform curtain of air. This uniform curtain of air then passes through the treatment zone 216 and into the floor plenum 214 via the openings 236 located within the second common plenum wall 212.

Figure 11:
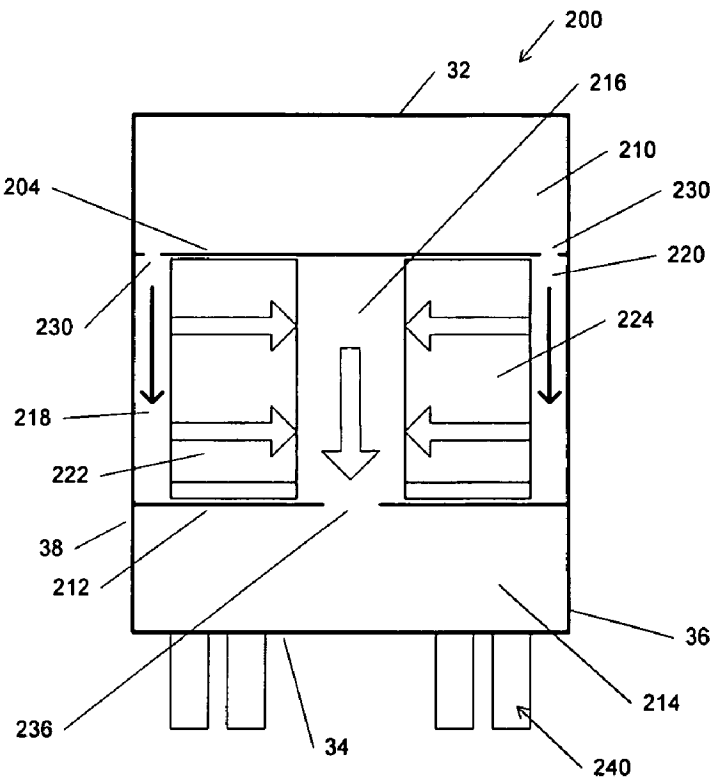
FIG. 11 is an end view of embodiment 200 illustrating the direction of air flow.
Figure 10:
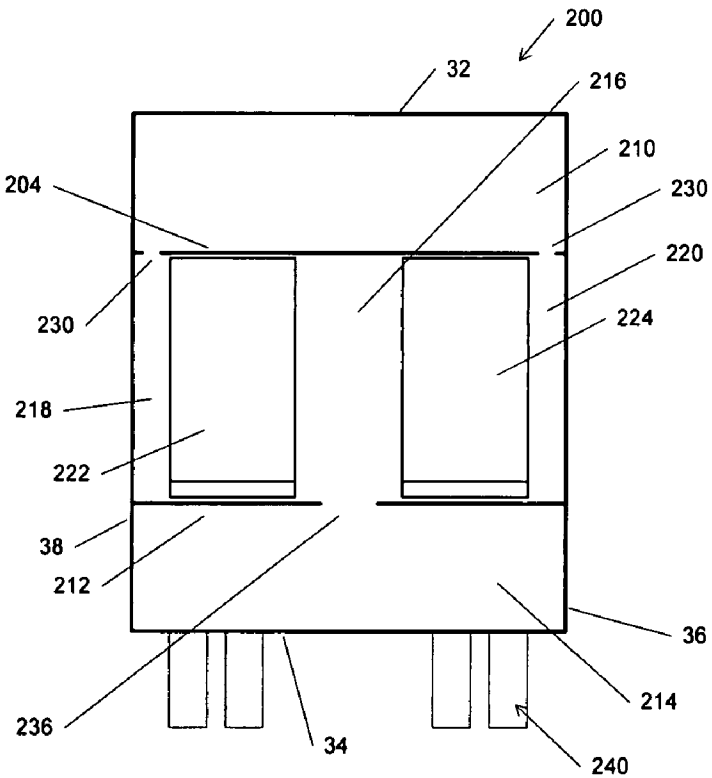
FIG. 10 is an end view of embodiment 200 illustrating transportation capability.
Figure 13:
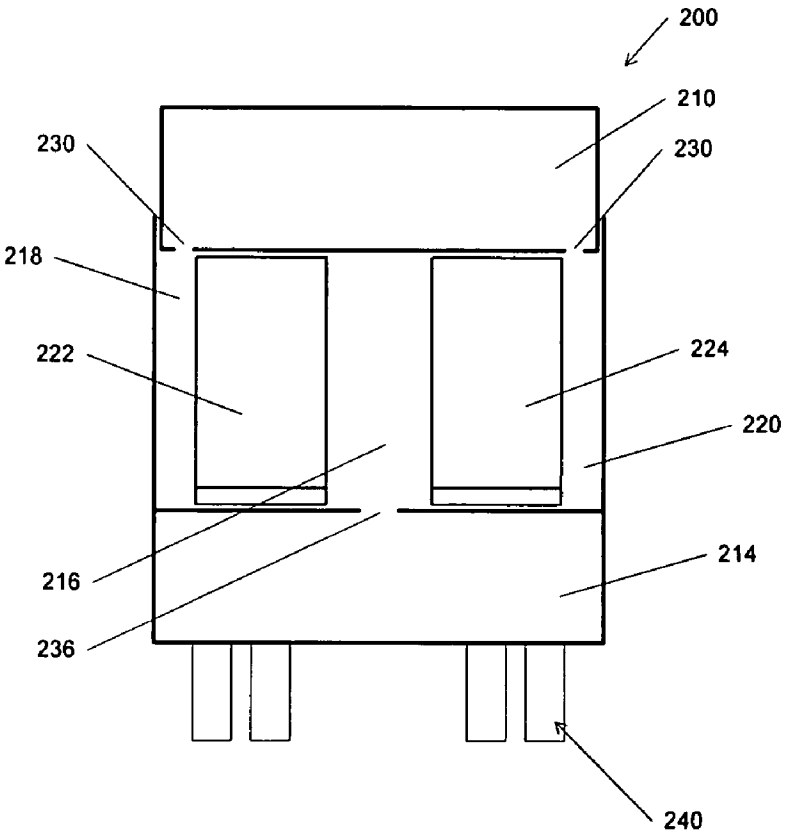
FIG. 13 is an end view of embodiment 200 illustrating the embodiment in a vertically telescoping mode.
Figure 12:
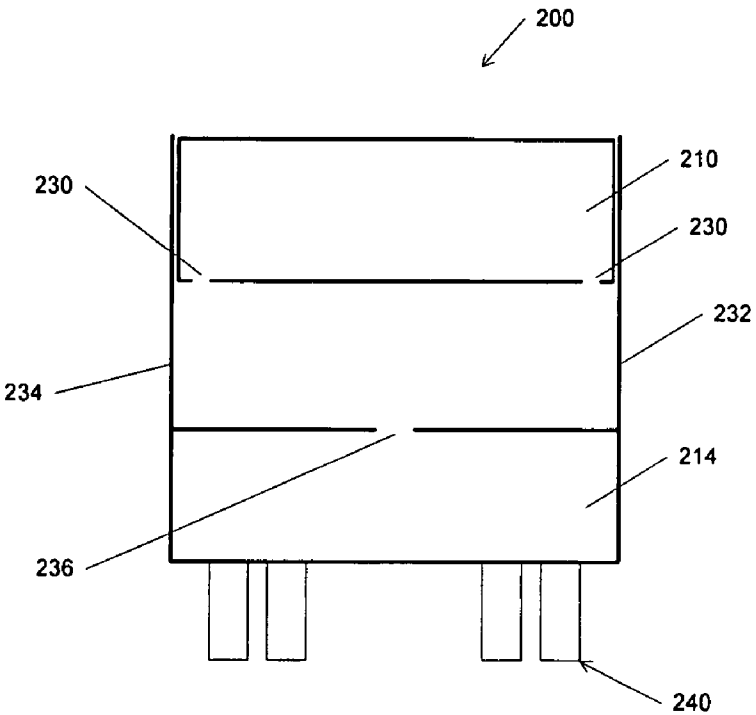
FIG. 12 is an end view of embodiment 200 illustrating the embodiment in a vertically retracted mode.
Figure 15:
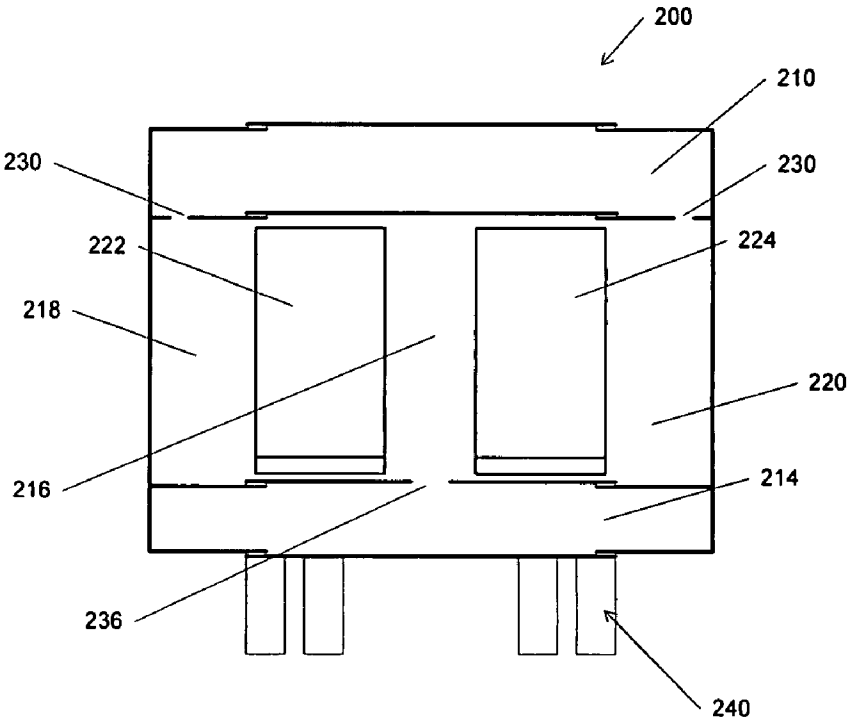
FIG. 15 is an end view of embodiment 200 illustrating the embodiment in a horizontally telescoping mode.
Figure 14:
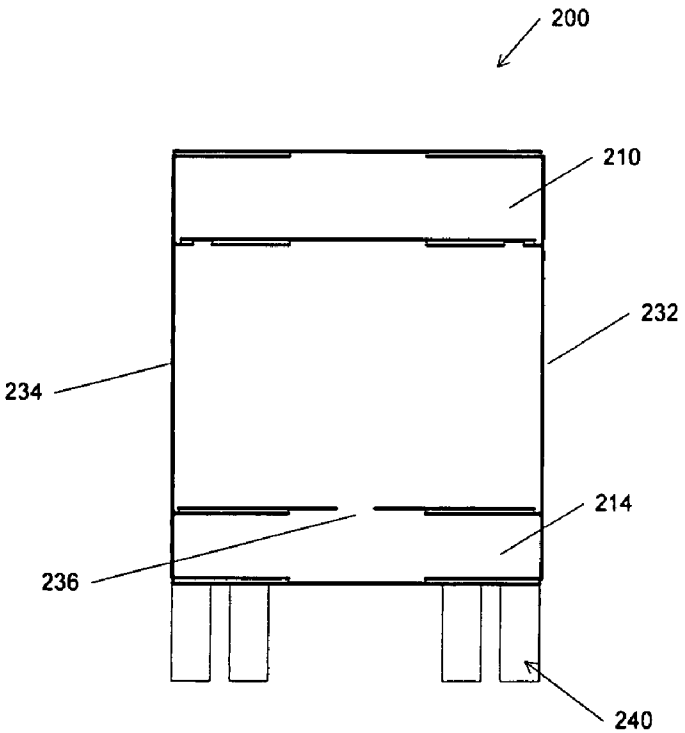
FIG. 14 is an end view of embodiment 200 illustrating the embodiment in a horizontally retracted mode.

FIGS. 10-11 illustrates an embodiment 200 having transportable capabilities. The housing 202 is part of a trailer apparatus 240. This allows for embodiment 200 to be moved to a location convenient for utilization. This capability can reduce the cost of transporting produce, fruits, vegetable to a processing center for conditioning. While these figures illustrate embodiment 200 being configured to be transportable, those skilled in the art would recognize that the embodiments of the present invention could be transportable. As such, the use of embodiment 200 is merely illustrative and not meant to be limiting.

Figure 17:
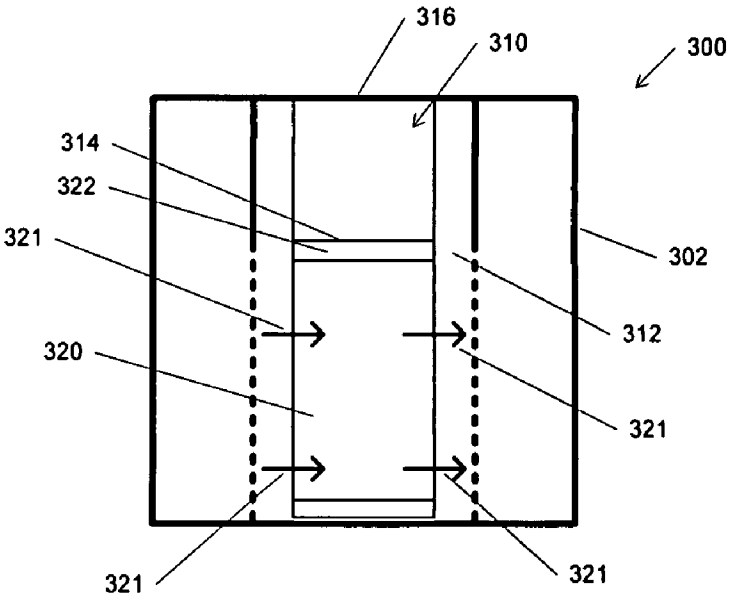
FIG. 17 is an end view of embodiment 300 of the present invention illustrating an embodiment of flow barrier 310 in an extended mode.
Figure 18:
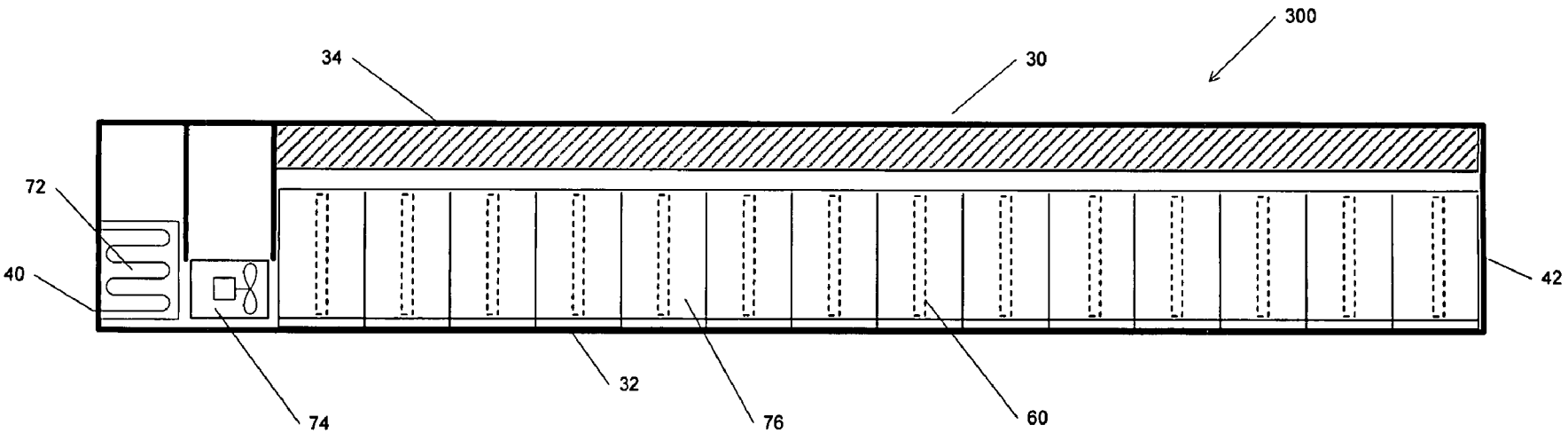
FIG. 18 is a side view of embodiment 300 of the present invention.
Figure 20:
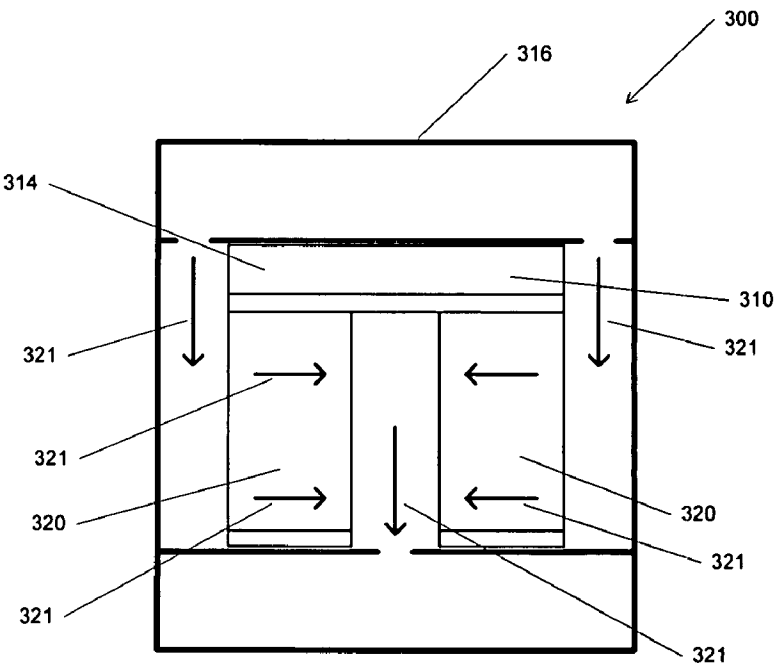
FIG. 20 is an end view of embodiment 300 of the present invention.
Figure 19:
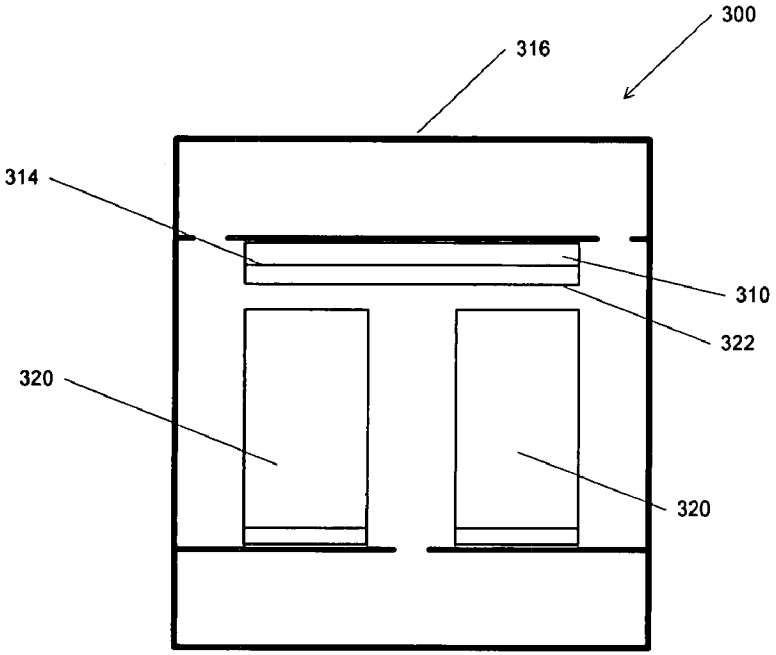
FIG. 19 is an end view of embodiment 300 of the present invention.

FIGS. 12-15 illustrate embodiment 200 in a transportable mode having the ability to modify the size of the housing 202 to accommodate more capacity within the treatment zone 216. FIGS. 17-18 illustrate the side walls 232, 234 being above to expand to increase the vertical height of the treatment zone 216. FIGS. 19-20 illustrate the floor 208 and ceiling 206, along with the respective plenum walls 204, 212.

Figure 16:
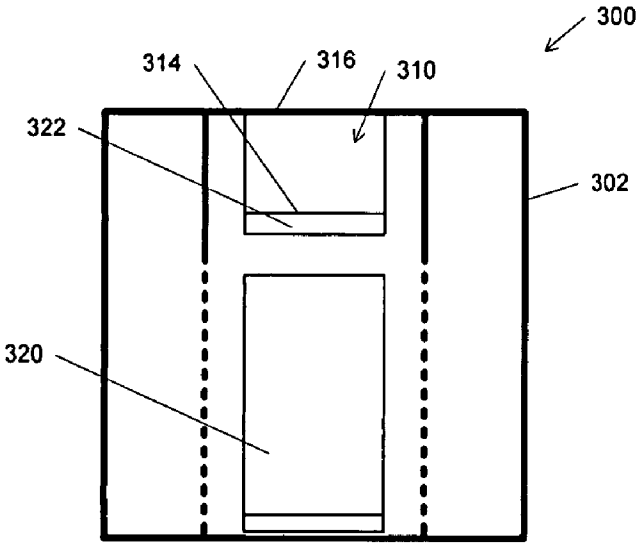
FIG. 16 is an end view of embodiment 300 of the present invention illustrating an embodiment of a flow barrier 310 in a retracted mode.

FIGS. 16-18 illustrate an additional embodiment 300 of the present invention. This embodiment 300 comprises a housing 302 as set out above and further including a flow barrier 310 to further restrict the air flow through the treatment zone 312. This embodiment of flow barrier 310 includes a flow barrier plate 314 retractably secured to the ceiling 316 of the housing 302. The flow barrier plate 314 can be lowered, or extended, from the ceiling 316 onto the top of the items 320 in the treatment zone 312. This reduces or expands the amount of space above the items 320 and concentrates the air flow through the treatment zone 312. Flexible material 322 is secured to the interior side of the flow barrier plate 314, i.e the "items" side of the flow barrier plate 314. The flexible material 322 allows for the items, such as pallets to be in protected when in communication with flow barrier 310. Those skilled in the art recognize the raising and lowering of the flow barrier 310 can be accomplished through manual or automatic means along with actual or remote means. Additionally, this flow barrier could be used to allow both configuration, i.e. side plenums or ceiling/floor plenums to be operational. (FIGS. 19-20)

An other embodiment of the present invention comprises a method to cool fruits and vegetables including providing a cooling room and cooling the fruits and vegetables therein. The cooling room is configured as set out above. Cooling air is provided into one of the plenums. A ventilation system creates circulation of the cooling air, which passes from one plenum, via openings contained in the plenum wall, through the treatment zone and into the other plenum via, openings contained in the other plenum wall. The openings allow for a substantially uniform pressure and velocity state of the air flow across the longitudinal length of the plenum.

While the invention has been described with a certain degree of particularity, it is understood that the invention is not limited to the embodiments set forth herein for purposes of exemplification, but is to be limited only by the scope of the attached claims or including the full range of equivalency to which each element thereof is entitled.

What is claimed is:

1. An apparatus for cooling produce comprising:

a box-like housing having a ceiling, a floor, a first side wall, a second side wall being opposite said first side wall, a first end wall, a second end wall being opposite said first end wall, a first common plenum wall located between said first side wall and said second side wall proximate to said first side wall, and creating a first plenum between said first common plenum wall and said first side wall, a second common plenum wall located between said first side wall and said second side wall proximate to said second side wall, and creating a second plenum between said second plenum wall and said second side wall, and defining a treatment zone between said first common plenum wall and said second common plenum wall; and a flow barrier having a flat planer member retractably connected to said ceiling and being retractably extendable from said ceiling into said treatment zone reducing the overall height of said treatment zone, said treatment zone being dimensioned to accommodate a row of pallets therein, said first plenum having a first opening to allow the passage of conditioning air to pass therethrough;

said second plenum having a second opening to allow the passage of said conditioning air to pass therethrough, said first common plenum wall having a plurality of first openings to allow said conditioning air to pass between said first plenum and said treatment zone, said second common plenum wall having a plurality of second openings to allow said conditioning air to pass between said second plenum and said treatment zone; and a ventilation apparatus in communication with said second opening to provide circulation to said conditioning air.

2. The apparatus of claim 1 wherein said flow barrier further comprising a flexible material secured to the interior side of flat planer member.

3. The apparatus of claim 1 wherein said flow barrier is manually retractable.

4. The apparatus of claim 1 wherein said flow barrier is remotely retractable.

5. The apparatus of claim 1 wherein said flow barrier is automatically retractable.

6. An apparatus for cooling produce comprising:

a box-like housing having a ceiling, a floor, a first side wall, a second side wall being opposite said first side wall, a first end wall, a second end wall being opposite said first end wall, a first common plenum wall being located between said ceiling and floor proximate to said ceiling, and creating a first plenum between said first common plenum wall and said ceiling, a second common plenum wall being located between said ceiling and said floor proximate to said floor, and creating a second plenum between said second plenum wall and said floor, and defining a treatment zone between said first common plenum wall and said second common plenum wall, said treatment zone being dimensioned to accommodate two rows of pallets while creating a third plenum between said row of pallets, a fourth plenum between the row of pallets proximate said first side wall and said first side wall and a fifth plenum between the row of pallets proximate said second side wall and said second side wall;

said first plenum having a first opening to allow the passage of conditioning air to pass therethrough;

said second plenum having a second opening to allow the passage of said conditioning air to pass therethrough, said first common plenum wall having a plurality of first openings to allow said conditioning air to pass between said first plenum and fourth and fifth plenums, said second common plenum wall having a plurality of second openings to allow said conditioning air to pass between said second plenum and said treatment zone; and a ventilation apparatus in communication with said second opening to provide circulation to said conditioning air.

7. The apparatus of claim 6, further comprising a flow barrier having a flat planer member retractably connected to said first common plenum wall and being retractably extendable from said first common plenum wall into said treatment zone reducing the overall height of said treatment zone.

8. The apparatus of claim 7, wherein said ventilation apparatus can be adjusted to provide circulation from either said first opening or said second opening.

9. The apparatus of claim 6, wherein said first side wall, said second side wall, said first end wall and said second end wall are telescopingly expandable.

10. The apparatus of claim 6, wherein said ceiling, said floor, said first end wall and said second end wall are telescopingly expandable.

* * * * *